US007192257B2

(12) United States Patent
Becker et al.

(10) Patent No.: US 7,192,257 B2
(45) Date of Patent: Mar. 20, 2007

(54) JET PUMP FOR BOOSTING PRESSURE AT AN INLET SUPPLIED FROM A SUMP AND SECOND FLUID SOURCE

(75) Inventors: Lee Becker, Canton, MI (US); Timothy Droste, Howell, MI (US); Vladimir Yasnogorodskiy, Southfield, MI (US); Thomas Tibbles, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 700 days.

(21) Appl. No.: 10/662,105

(22) Filed: Sep. 12, 2003

(65) Prior Publication Data

US 2005/0058550 A1 Mar. 17, 2005

(51) Int. Cl.
*F04F 5/02* (2006.01)

(52) U.S. Cl. ..... 417/79; 417/89

(58) Field of Classification Search ..... 417/87, 417/89, 79

See application file for complete search history.

(56) References Cited

U.S. PATENT DOCUMENTS 3,620,646 A * 11/1971 Stevenson et al. ..... 417/79
3,981,626 A * 9/1976 Onal ..... 417/89
4,033,706 A * 7/1977 Schaefer et al. ..... 417/79
5,878,632 A 3/1999 Hübler et al.
6,155,793 A * 12/2000 Tuckey et al. ..... 417/87
6,572,339 B2 * 6/2003 Walton et al. ..... 417/87
6,666,655 B2 * 12/2003 Heath et al. ..... 417/87

FOREIGN PATENT DOCUMENTS

JP 53-36707 A * 4/1978

* cited by examiner

*Primary Examiner*—Michael Koczo, Jr.
(74) *Attorney, Agent, or Firm*—David B. Kelley; MacMillan, Sobanski & Tool

(57) ABSTRACT

The automatic transmission for motor vehicles includes a positive displacement pump, a sump hydraulically connected by a passage to the pump inlet, a line pressure control valve having a high pressure outlet, a passage carrying fluid from the control valve through a nozzle and an nozzle exit opening to the passage that connects the sump to the pump inlet. The high pressure passage has a cross section whose area decreases in the direction toward the pump inlet and terminates in a nozzle through which a high speed jet enters the low pressure passage through the nozzle exit opening.

16 Claims, 3 Drawing Sheets

10
14
3
32
4
30
28
18
22
12
16
3
4
20
26
34
24
36

36
28
A
50
34
44
48
46
52
42
68
64
40
70
38

JET PUMP FOR BOOSTING PRESSURE AT AN INLET SUPPLIED FROM A SUMP AND SECOND FLUID SOURCE

BACKGROUND OF THE INVENTION

The invention relates to the field of hydraulic pumps for automatic transmissions; in particular, it pertains to a jet pump having a high-speed stream that draws fluid from a sump and pressurizes the inlet of a positive displacement pump.

Pressurized fluid for actuating the friction control elements of an automatic transmission for a motor vehicle is provided by a line pressure control valve. A positive displacement pump is used to supply fluid from a sump to the control system for actuation and lubrication of the transmission components. The line pressure control valve maintains line pressure within acceptable limits by releasing, through the control valve, excess fluid produced by the pump. However, a positive displacement pump requires a constant supply of fluid at a flow rate equal to the flow rate at the pump outlet. The volumetric flow rate of the pump increases in proportion to the speed of the pump, which is driven directly from the crankshaft of an internal combustion engine.

Unless the flow rate supplied to the pump inlet is sufficient to equal or exceed the flow rate at the pump outlet, fluid pressure at the inlet can approach one atmosphere of negative pressure, in extreme conditions. Low pressure at the pump inlet causes cavitation, a condition in which an air-fluid mixture is drawn into the pump inlet. As a result of vaporizing or boiling the fluid, the pump can be damaged when the cavitation bubbles collapse in the constriction pump chambers. Furthermore, cavitation produces noise and pressure fluctuations in the hydraulic system.

At high speed, positive displacement pumps for automatic transmission produce a larger flow rate than is required by the hydraulic system it supplies. A large flow rate of fluid must be supplied to the pump inlet to avoid cavitation and other harmful conditions, particularly under high-speed conditions. It is important also to avoid back pressure at the outlet of the line pressure control valve, which would increase the pump load and lead to inefficient operation, reduced fuel economy, and possible overpressurization of the friction control elements.

There is a need for a system to provide a reliable steady stream of pressurized fluid at the inlet of a positive displacement pump. Furthermore, because the available space for the pump and the control body is small, the system must be compact.

SUMMARY OF THE INVENTION

The jet pump according to the present invention is used to reduce noise, vibration, and harshness normally associated with a transmission pump. Waste oil from the fixed displacement pump is recirculated to the pump inlet to boost the high-speed fill limit, i.e., the cavitation speed of the pump. Pressurized fluid is supplied in a continuous stream to the pump inlet by the effect of a high-speed fluid jet from the control valve.

The system employs a fluid flow passage in which a well developed stream of high-speed fluid flows through a nozzle into a fluid stream from a low pressure sump. Because the fluid stream exiting the nozzle is well developed, it has a lower discharge loss coefficient and lower losses than the corresponding coefficient and discharge losses associated with an undeveloped or less well developed flow stream. Fluid flow from the nozzle is substantially parallel to, and in the same direction as a fluid stream in a fluid passage leading from the sump to the pump inlet. The high speed jet stream is centrally located and aligned with the passage leading to the pump inlet, and is substantially perpendicular to the throat of the passage leading to the pump inlet.

A system according to this invention for supplying fluid to a pump inlet includes a hydraulic pump having an inlet through which fluid enters the pump. Fluid from a source of fluid at relatively low pressure, such as a sump, is carried through a first passage that hydraulically connects the sump and the pump inlet. Fluid from a source of fluid at relatively high exit velocity is carried in a second passage that hydraulically connects the second fluid source and the first passage. The second passage has a length and a cross section whose area decreases along the length in a direction toward the first passage, and includes a nozzle, which directs a jet of fluid exiting the nozzle into the first passage.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
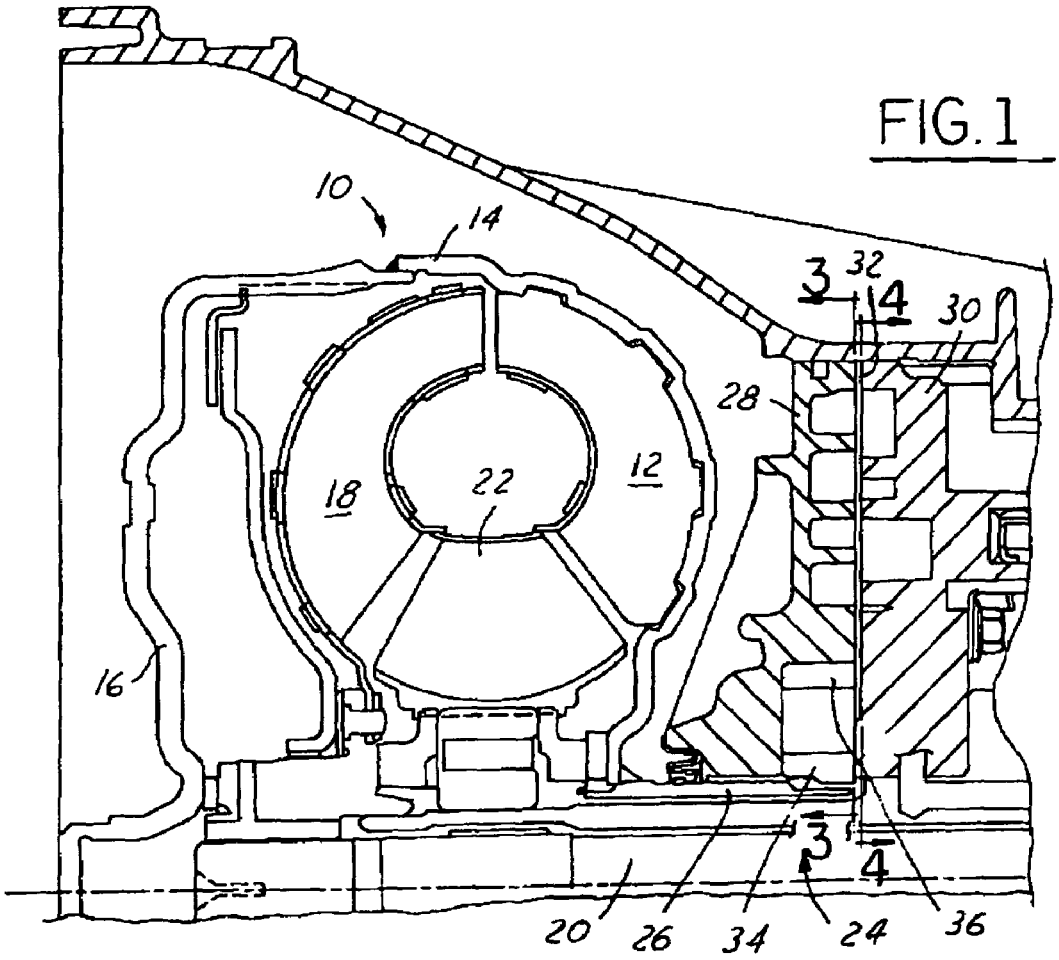
FIG. 1 a partial cross section through an automatic transmission in the area of a torque converter and positive displacement pump.

Referring now to the drawings, there is illustrated in FIG. 1 in schematic form a front portion of a multiple-ratio automatic transmission for an automotive vehicle. A hydrokinetic torque converter 10 includes a bladed impeller wheel 12, driveably connected through a casing 14 and a flywheel 16 to an engine shaft. A bladed turbine wheel 18 is driveably connected to the gearing through an input shaft 20. A bladed stator wheel 22, located between the impeller and turbine, is supported on a one-way coupling. The impeller, turbine and stator are located in a toroidal fluid flow circuit, the turbine being hydrokinetically coupled to the impeller. The impeller 12 is connected to a pump shaft 26.

A positive displacement, duocentric pump 24, driveably connected by pump shaft 26 to impeller 12, is located in a pump cover 28. A control body 30, containing various hydraulic control valves and fluid channels or passages, surrounds the pump 24 and is spaced from pump cover 28 by a separator plate 32. p The pump 24 includes an internal rotor gear 34 having nine exterior teeth. An external gear 36 having ten internal teeth or lobes meshes with and is driven by the internal rotor. The impeller 12 and internal pump rotor 34 turn at the speed of the engine shaft. Spaces between the meshing teeth of the internal rotor 34 and external pump gear 36 are pumping chambers, in which fluid travels about the axis of the pump from the inlet side of the pump to the outlet side. Fluid is compressed due to an eccentric rotation of rotor 34 within external gear 36.

Pump 24 is supplied with fluid from an oil sump or reservoir 38 through a suction filter 40 and the control body 30, which contains a passage 42 leading to the pump inlet area 44. Passage 42 contains a throat 46 and a short diffuser 48.

Excess fluid volume exiting a line pressure control valve 50 through passage 52 flows though passages in the control body 30, separator plate 32, and pump cover 28 to a nozzle 64, which exits at an opening 68, through which a jet of high speed fluid enters the passage 42. The fluid jet and fluid from the sump merge in passage 42, pass through a throat 46 and diffuser 48, and enter the pump 24 at the pump inlet, where the spaces between the rotor and stator teeth increase in size as the rotor 34 rotates on the inner surface of the stator 36. The passages that carry fluid from valve 50 to nozzle 64 are designed particularly to avoid back pressure at the exit from valve 50. The area of the opening 68 is sized to cause a high velocity fluid jet exiting the nozzle 64 to be directed into the center of the throat 46.

Figure 3:
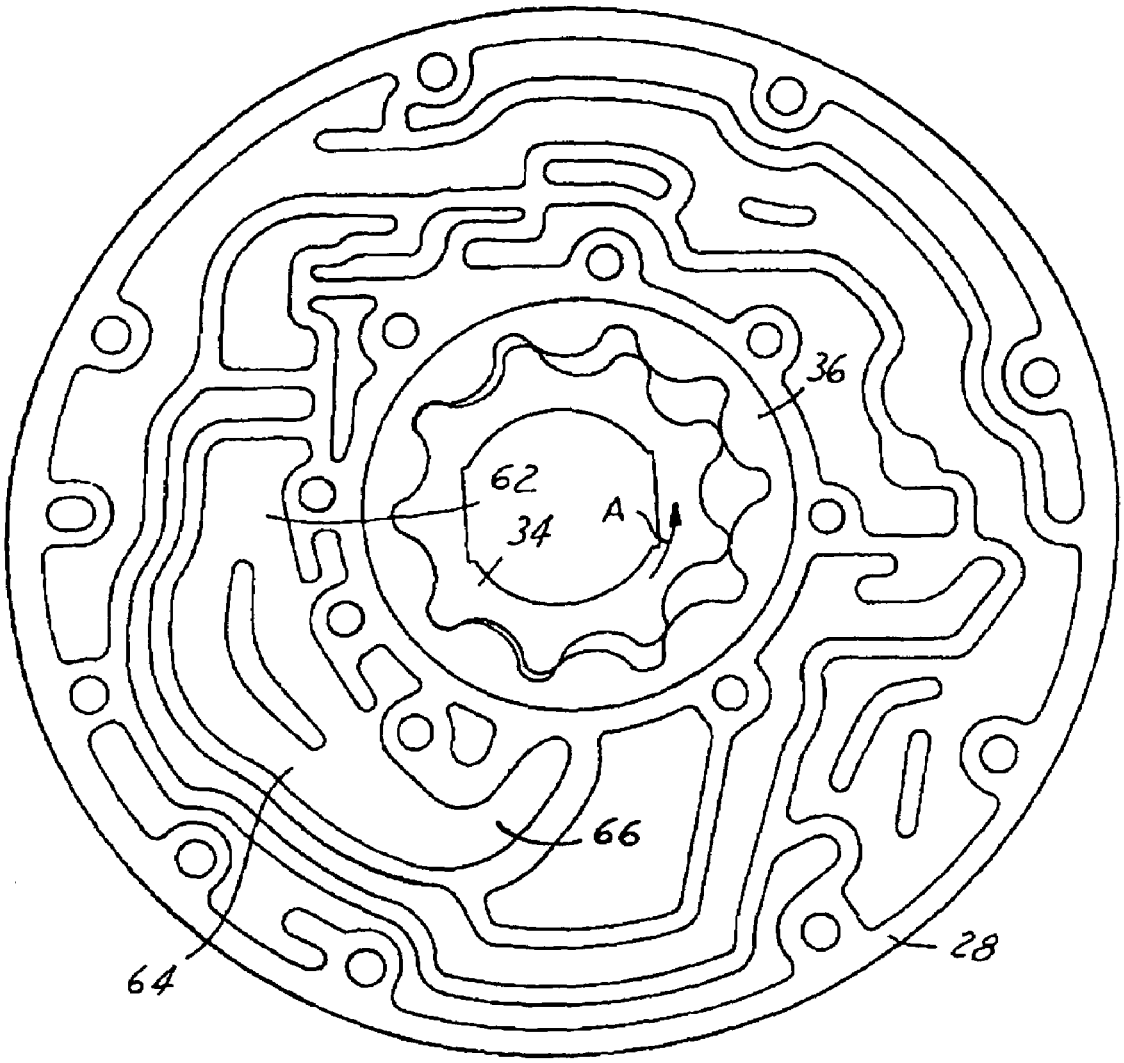
FIG. 3 is an end view of the pump cover.
Figure 4:
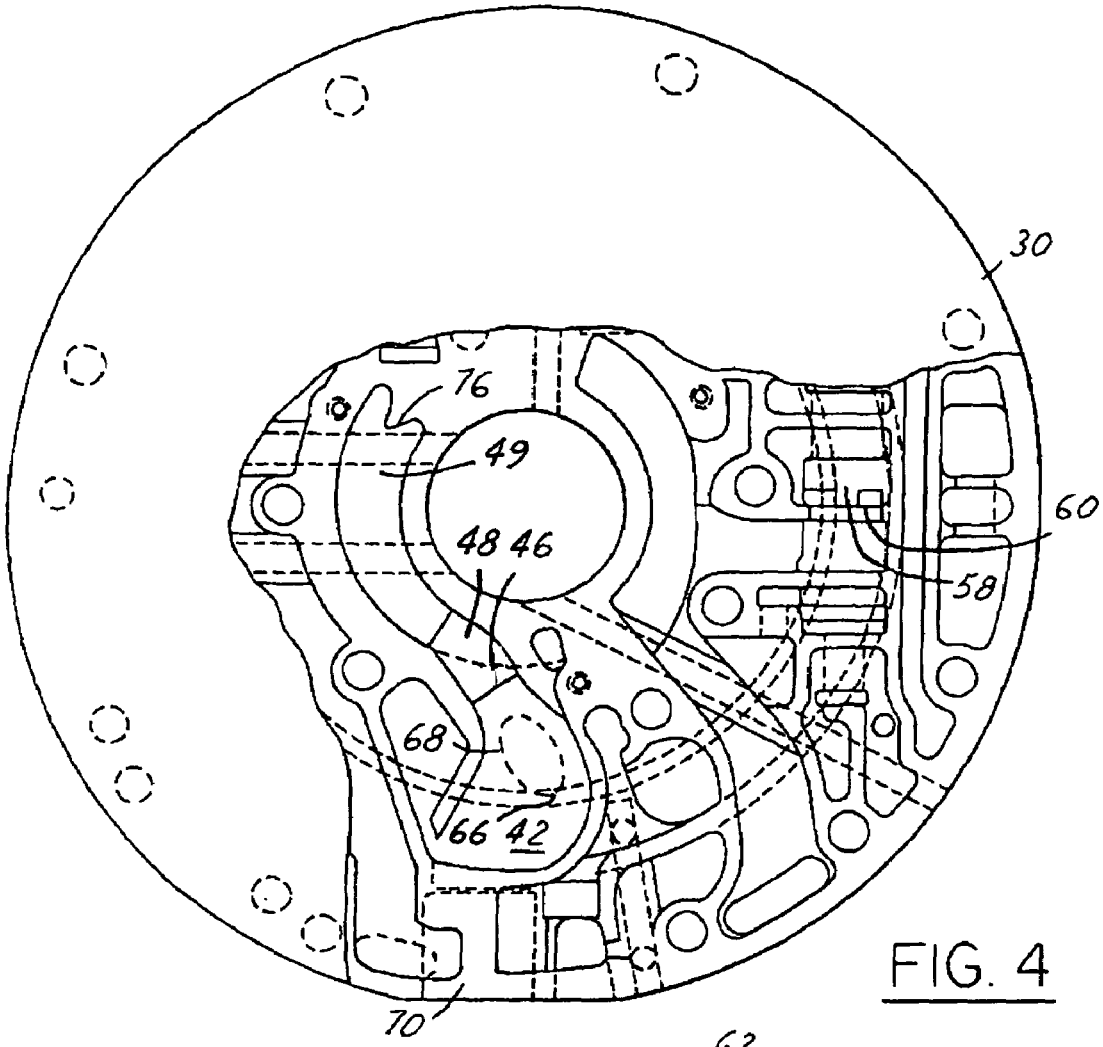
FIG. 4 is an elevation end view of the pump cover showing passages related to this invention.

FIG. 3 shows the portion of the fluid flow path in the pump cover 28 traveled by fluid leaving the exit 58 of the main regulator valve 50, which is formed in the control body 30, shown in FIG. 4. Fluid flows through a rectangular passage 60 having a perimeter surrounding exit 58 and formed in the separator plate 32, into the pump cover 28. The rectangular passage 60 in the separator plate 28 is located immediately axially adjacent a first end 62 of the fluid passage or nozzle 64. The separator plate 28, which covers nozzle 64, is formed with an elliptical or oval opening 68 located axially adjacent the exit end 66 of nozzle 64 , thereby providing an opening through which fluid returns to the control body 30 from nozzle 64.

The largest cross sectional area of nozzle 64 is located near the end 62 of the nozzle. The cross sectional area of nozzle 64 continually decreases along the 25 length of the nozzle from the entrance end 62 to the exit end 66. Therefore, the velocity of fluid in nozzle 64 steadily increases from the entrance end 62 to a high velocity jet at the exit end 66 as the cross sectional area decreases along the nozzle length. The smallest cross sectional area of the nozzle can be described by an imaginary plane perpendicular to the separator plate 32 and intersecting the pump cover 28 at location 66, which is located at the tip of the elliptical exit opening. The elliptical exit opening is larger to permit development of this high velocity, developed flow exiting the nozzle at 66, to pass through and remain directed at the center of throat 46.

Figure 5:
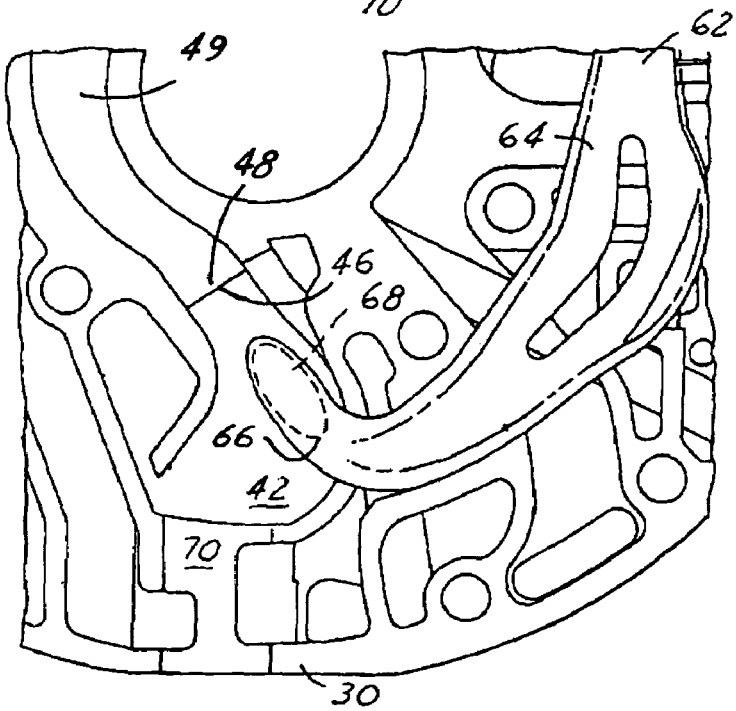
FIG. 5 is a perspective view showing a fluid passage in the pump cover and a passage in the control body near the throat, with the separator plate removed.

FIGS. 4 shows the location of the elliptical opening 68 in the separator plate 32 projected onto the inner surface of the control body 30. FIG. 5 shows both the nozzle 64 in the pump cover 28 and exit opening 68 in the separator plate 32 projected onto the inner surface of the control body 30.

Fluid from the sump 38 enters the control body 30 through an opening in the peripheral wall of the control body 30 and into a short passage 70 leading to passage 42 and the location of the opening 68. Throat 46 is the location in passage 42 where the cross section having the minimum area occurs. FIGS. 4 and 5 each show a trace of the elliptical exit opening 68 formed in the separator plate, the opening being located upstream from throat 46. FIG. 5 shows in greater detail the region where nozzle 64 directs fluid into the passage 42. Fluid from the sump 38 entering passage 42 through passage 70, and fluid from the exit 58 of the control valve 50 exiting nozzle 64 at location 66 and then through exit opening 68 are combined in passage 42 at the location of opening 68. Passage 42 carries the combined fluid streams through a short diffuser 48 to the pump inlet kidney 49 and the pump inlet.

The constricted area of the nozzle at location 66 creates a jet whose velocity is substantially parallel to, and in the direction of the fluid stream in passage 42. The high velocity fluid, exiting opening 68 and directed at the center of throat 46, draws fluid from the sump, and the combined fluid streams pass through passage 42 then through a short diffuser section to the pump inlet kidney 49 and the pump inlet 48. Fluid enters the spaces between the lobes of the internal and external pump gear teeth in the region of the inlet kidney 49, which terminates in a closed passage at 76.

The nozzle termination formed at location 66, where the cross sectional area of the nozzle is smallest, is aligned with the fluid stream in passage 42. Location 66 and opening 68 are centrally located between the lateral walls of passage 42. The jet stream leaving opening 68 is directed substantially parallel to the fluid stream in passage 42, except that the jet stream is directed slightly across the fluid stream in passage 42 due to the location of exit opening 68 at the upper surface of passage 42, as FIG. 5 shows.

Figure 2:
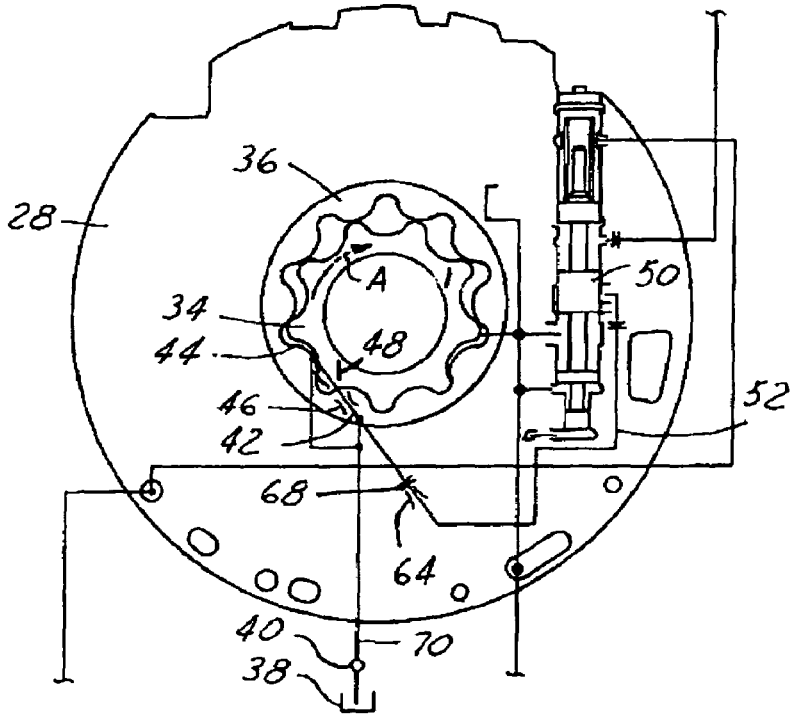
FIG. 2 is a schematic end view of the control body showing the line pressure control valve and related passages.

In this way, fluid exits the opening 68 at high velocity and enters the pump inlet port in the control body 30. The jet stream and the sump stream are mixed, resulting in a boosted pressure at the inlet of the pump 24. The rotor 34 rotates in the direction of arrow A in FIGS. 2 and 3, substantially tangential to the centerline of the diffuser passage 48.

Because the separator plate 28 covers both passage 42 in the control body 30 and passage 64 in the pump cover 28, the location, sire, velocity and direction of the jet stream that exits passage 64 through the elliptical opening 68 in the separator plate 28 is closely controlled and optimized.

Although the nozzle exit pressure is low due to the superior design and performance of this invention, generally its magnitude is greater than the pressure of the sump.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A system for supplying fluid to a pump, comprising:

a hydraulic pump including an inlet through which fluid enters the pump;

a first source of fluid at relatively low pressure;

a second source of fluid at relatively high pressure velocity;

a first passage for hydraulically connecting the first fluid source and the pump inlet;

a second passage hydraulically connecting the second fluid source and the first passage, including a nozzle having a length and a cross sectional area that decreases along the length in a direction toward the first passage, the nozzle terminating at an elliptical or oval exit opening, through which exit opening a jet of fluid exiting the nozzle enters the first passage.

2. The system of claim 1, wherein the pump further includes an outlet that is hydraulically connected to the second source.

3. The system of claim 1, wherein the first passage further includes a throat located along a length of the first passage between the exit opening and the inlet.

4. The system of claim 1, wherein the first passage further includes:

a throat located along a length of the first passage between the exit opening and the inlet; and a diffuser located along a length of the first passage between the throat and the inlet.

5. The system of claim 1, wherein the pump is a positive displacement pump.

6. The system of claim 1, wherein the first passage further includes:

lateral walls spaced mutually across a width of the first passage, and wherein the nozzle and exit opening are located substantially equidistant from the lateral walls of the first passage.

7. The system of claim 1, wherein;

the first passage further includes lateral walls spaced mutually across a width of the first passage, and the nozzle exit opening is directed along the first passage toward the inlet.

8. An assembly for supplying fluid to a pump in an automatic transmission, comprising:

a source of fluid at relatively high pressure;

a hydraulic pump including an inlet through which fluid enters the pump;

a sump for containing fluid at relatively low pressure;

a control body including a line pressure control valve providing a source of fluid at relatively high pressure, and a first channel having a base, side walls and an open top, the first channel hydraulically connecting the sump and the pump inlet;

a pump cover facing the control body, including a second channel hydraulically connecting the fluid source and the first channel, the second channel including a nozzle having a base, side walls, an open top, a length, and a cross sectional area that decreases along the length in a direction toward the first channel; and a separator plate located between control body and the pump cover, covering the open tops of the first channel and second channel, including an exit opening located adjacent the nozzle, through which exit opening a jet of fluid exiting the nozzle enters the first channel.

9. The assembly of claim 8, wherein the pump further includes an outlet that is hydraulically connected to a control valve.

10. The assembly of claim 8, wherein the first passage further includes a throat located along a length of the first channel between the exit opening and the inlet.

11. The assembly of claim 8, wherein the first channel further includes:

a throat located along a length of the first channel between the exit opening and the inlet; and a diffuser located along a length of the first channel between the throat and the inlet.

12. The assembly of claim 8, wherein the pump is a positive displacement pump having a rotor including lobes, a stator including lobes meshing with the lobes of the rotor, and an inlet located between the rotor and stator.

13. The assembly of claim 8, wherein the pump is a positive displacement pump.

14. The assembly of claim 8, wherein the first channel further includes:

lateral walls spaced mutually across a width of the first channel, and wherein the nozzle and exit opening are located substantially equidistant from the lateral walls of the first channel.

15. The assembly of claim 9, wherein the first channel further includes:

lateral walls spaced mutually across a width of the first channel, and wherein an exit of the nozzle is directed along the first channel toward the inlet.

16. The assembly of claim 8, wherein the nozzle exit opening is elliptical or oval.

* * * * *